US008919272B2

(12) United States Patent
White

(10) Patent No.: US 8,919,272 B2
(45) Date of Patent: Dec. 30, 2014

(54) AERODYNAMIC LIFT DEVICE AND METHODS OF USING THE SAME

(76) Inventor: Christopher Robert White, South Dartmouth, MA (US)

( * ) Notice: Subject to any disclaimer, the term of this patent is extended or adjusted under 35 U.S.C. 154(b) by 0 days.

(21) Appl. No.: 13/606,259

(22) Filed: Sep. 7, 2012

(65) Prior Publication Data

US 2013/0061791 A1 Mar. 14, 2013

Related U.S. Application Data

(60) Provisional application No. 61/573,129, filed on Sep. 9, 2011.

(51) Int. Cl.

| | |
|---|---|
| ***B63H 9/04*** | (2006.01) |
| ***B63H 9/10*** | (2006.01) |
| ***B63B 15/00*** | (2006.01) |

(52) U.S. Cl.

CPC .. *B63H 9/04* (2013.01); *B63H 9/10* (2013.01); *B63B 15/0083* (2013.01)

USPC ..... 114/39.31; 114/39.29; 114/102.14; 114/102.1

(58) Field of Classification Search

CPC ..... B63B 15/02; B63H 9/04

USPC ..... 114/39.29, 39.31, 102.29, 102.32, 114/102.33

See application file for complete search history.

(56) References Cited

U.S. PATENT DOCUMENTS

| | | | | |
|---|---|---|---|---|
| 3,032,848 | A * | 5/1962 | Allen | 24/599.7 |
| 3,408,973 | A * | 11/1968 | Curtis et al. | 114/98 |
| 4,685,410 | A * | 8/1987 | Fuller | 114/39.31 |
| 4,690,088 | A * | 9/1987 | Perini | 114/102.14 |
| 4,848,258 | A * | 7/1989 | Priebe | 114/39.31 |

* cited by examiner

*Primary Examiner* — Edwin Swinehart

(74) *Attorney, Agent, or Firm* — Lathrop & Gage LLP; Anthony J. Janiuk

(57) ABSTRACT

Embodiments of the present invention feature a device having aerodynamic lift surfaces that is capable of rotation about a stayed mast.

21 Claims, 3 Drawing Sheets

AERODYNAMIC LIFT DEVICE AND METHODS OF USING THE SAME

RELATED APPLICATIONS

This Application is a continuation in part of a provisional patent application Filed Sep. 9, 2011, entitled "Novel and Aerodynamically Efficient Sailboat Mast", Ser. No. 61/573,129, to which priority is claimed and the contents of which are incorporated by reference.

STATEMENT REGARDING FEDERAL SPONSORSHIP

Embodiments of the present invention were conceived and made without Federal sponsorship.

FIELD OF INVENTION

The present invention relates to aerodynamic lift devices for watercraft, ice craft and land craft which are powered wind.

BACKGROUND OF THE INVENTION

Unless the context of the text requires otherwise, the term "craft" means any vehicle, watercraft, or ice craft. Examples of a vehicle would include wheeled vehicles and the like. Watercraft comprise by way of example, without limitation single, multihull and hydrofoil vessels. As used herein, ice craft comprise vehicles having skis and/or skate like blades for traveling over ice or snow surfaces.

As used herein, the term "mast" will mean a rigid structural member projecting in a generally vertical direction from a deck or base to which it is attached. A "stay" is rigid or flexible structural member providing lateral support to a mast to which it is attached. A stay is generally attached to a mast at a point away from the mast's point of attachment at a deck or base, that is, up the mast, and secured to the deck or mast away from, or distal to the attachment of the mast to the deck or base.

As used herein, the term "sail" means a flexible sheet in the nature of fabric, membrane, or sheet used to capture wind or provide an aerodynamic lift.

It is desirable to have a sailing mast capable of carrying rigid aerodynamic lift surfaces that can be controlled through all wind directions, and structurally robust to also carry one or more sails.

SUMMARY OF THE INVENTION

Embodiments of the present invention feature a device capable of carrying rigid aerodynamic lift surfaces that can be controlled through all wind directions, and is structurally robust for carrying one or more sails and methods of using such mast. One embodiment is directed to a device for powering a craft by aerodynamic forces. For example, without limitation, the craft has a mast member having a base end, a top end and an elongated body. The base end is constructed and arranged for attachment to a base of a craft and the top end has one or more stay attachment points for at least one stay. The at least one stay has a mast securing end and a craft securing end. The at least one stay and the elongated body define at least one cone of rotation when secured to the craft and mast member. At least one of the cones of rotation is a minimal cone of rotation. The device comprises a fairing member constructed and arranged for rotational attachment to the mast and substantially encasing the elongated body. The fairing member has a base end and a top end corresponding to the mast member and has a first section and a second section. The first section extends from the base towards a point inside the minimum cone of rotation. The first section has a symmetrical aerofoil cross-sectional shape with a projecting rounded forward face and an extending tapered back. The second section extend from the first section to the about the top end and has a cross-sectional shape, a second forward face and a second back. The second forward face projecting no further than and substantially parallel to the minimum cone of rotation, and the second back extending no further than and substantially parallel to the minimum cone of rotation. The fairing member can be rotated a full rotation about the mast to assume one or more positions relative to a wind to provide aerodynamic lift and one or more positions in which the fairing member provides no aerodynamic lift.

The fairing member allows the mast member, supported and stabilized by one or more stays, to withstand extreme wind conditions. The fairing can be released to feather in the wind, in the position in which no aerodynamic lift is generated, without interference from the stays. The device, fitted to a conventional mast equipped with stays, permits retrofitting of craft formerly fitted with sails.

One embodiment features a fairing member having a fairing length and the forward face and extending tapered back define a fairing chord distance. The chord distance is approximately constant in the first section. The ratio of the fairing length and fairing chord distance is between 5:1 and 60:1. A further embodiment features a ratio of the fairing length and fairing chord distance is between 8:1 and 45:1. And, in a further embodiment the fairing length and fairing chord ratio is between 9:1 and 35:1.

An embodiment of the present invention further comprises a flap. The flap has a first flap section and a second flap section. The first flap section has a symmetrical aerofoil shape having a flap front and a flap back, and having a flap chord extending therebetween. The flap is moveably affixed at the flap front to the extending tapered back of the fairing. The flap first section extends from the tapered back of the fairing member, from the base to a point inside the minimum cone of rotation by a distance of the flap chord. The second flap section extends from the first flap section to the approximately the second section of the fairing member and having a flap back edge substantially parallel to and inside the minimum cone of rotation. The flap is moveable to assume one or more positions relative to the fairing member to increase aerodynamic lift or moveable to assume a position in which the flap provides no aerodynamic lift.

One embodiment of the present device features a fairing member having a fairing length and the forward fairing face and flap back define a fairing flap chord distance which is approximately constant through the first flap section, the ratio of the fairing length and fairing flap chord distance is between 5:1 and 60:1. And, in a further embodiment the ratio of the fairing length and fairing flap chord distance is between 8:1 and 45:1. And, in a further embodiment the fairing length and fairing flap chord ratio is between 9:1 and 35:1.

The embodiments of the present device feature fairing member having an exterior shell selected from the group of materials consisting of plastic, aluminum, fiber glass, carbon fiber and fabric. Non-rigid materials need to be placed over a structural skeleton or a core. A core allows rigid exterior shell materials to be used in a manner minimizing thickness. Core materials are selected from the group consisting of expanded plastic foam, balsa wood and honeycomb materials. A preferred core has an axial hollow for rotationally receiving the mast.

Embodiments of the present device further comprising one or more bearing means interposed between the fairing member and the mast. The bearing members reduce friction between the fairing member and the mast.

Embodiments of the present device feature fairing control means for compelling said fairing member to assume a position with respect to the wind. And, embodiments which comprise a fairing member and flap, at least one of the fairing member and flap has flap control means for compelling the flap to assume a position with respect to the wind.

One embodiment of the present device comprises a mast. However, the device can readily be fitted to existing masts. Similarly, the device may further comprise a craft body. The mast is secured to the craft body by at least one head stay. One embodiment features at least one head stay that carries a sail. Preferably, the sail is fitted to a boom and the boom extends from about the head stay at the craft body to a point towards the mast allowing the fairing member, and if the device comprises a fairing member and flap, allowing the fairing member and flap, to freely rotate.

A further embodiment of the present invention is directed to a method for powering a craft by aerodynamic forces. The craft has a mast member having a base end, a top end and an elongated body, with the base end constructed and arranged for attachment to a base of a craft and the top end having one or more stay attachment points for at least one stay. The at least one stay having a mast securing end and a craft securing end, the at least one stay and the elongated body defining at least one cone of rotation when secured to the craft and mast member, and at least one of the cones of rotation being a minimal cone of rotation. The method comprises the step of providing a device having a fairing member constructed and arranged for rotational attachment to the mast and encasing substantially the elongated body. The fairing member has a base end and a top end corresponding to the mast member and has a first fairing section and a second fairing section. The first fairing section extends from the base towards a point inside the minimum cone of rotation. The first fairing section has a symmetrical aerofoil cross-sectional shape with a projecting rounded forward face and an extending tapered back. The second fairing section extends from the first section to the about the top end and has a cross-sectional shape a second forward face and a second back. The second forward face projects no further than and substantially parallel to the minimum cone of rotation, and the second back extends no further than and substantially parallel to the minimum cone of rotation. Thus, the fairing member can be rotated a full rotation about the mast to assume one or more positions relative to a wind to provide aerodynamic lift and one or more positions in which the fairing member provides no aerodynamic lift. The method further comprises the step of rotating the fairing member to assume the one or more positions relative to the wind to provide aerodynamic lift to power the craft and rotating or allowing the fairing member to passively assume the one or more positions in which the fairing member provides no aerodynamic lift when it is desired to maintain the craft in an unpowered state.

Embodiments of the present method further comprise a device having a fairing and a flap. The method further comprises the step of rotating the flap to provide aerodynamic lift to power the craft and rotating or allowing the flap to passively assume the one or more positions in which the flap provides no aerodynamic lift when it is desired to maintain the craft in an unpowered state.

These and other features and advantages of the present invention will be apparent to those skilled in the art upon viewing the Drawings and reading the detailed description that follows.

DETAILED DESCRIPTION OF THE INVENTION

Embodiments of the present invention will be described in detail as a device having rigid aerodynamic lift surfaces that can be controlled through all wind directions, and comprising or used in conjunction with a mast and a sailing vessel, such as a single hulled or multi-hulled boat. Those skilled in the art will recognize that the device may be used on land craft or ice boats as well. The depictions of the device used on watercraft feature larger vessels with the understanding that smaller vessels and crafts, including simple board-like craft can readily be used with embodiments of the present invention. These described embodiments exemplify the best mode of the invention and the manner of making and using such invention. However, embodiments of the present invention are subject to modification and alteration and the best mode contemplated may change over time.

Figure 1:
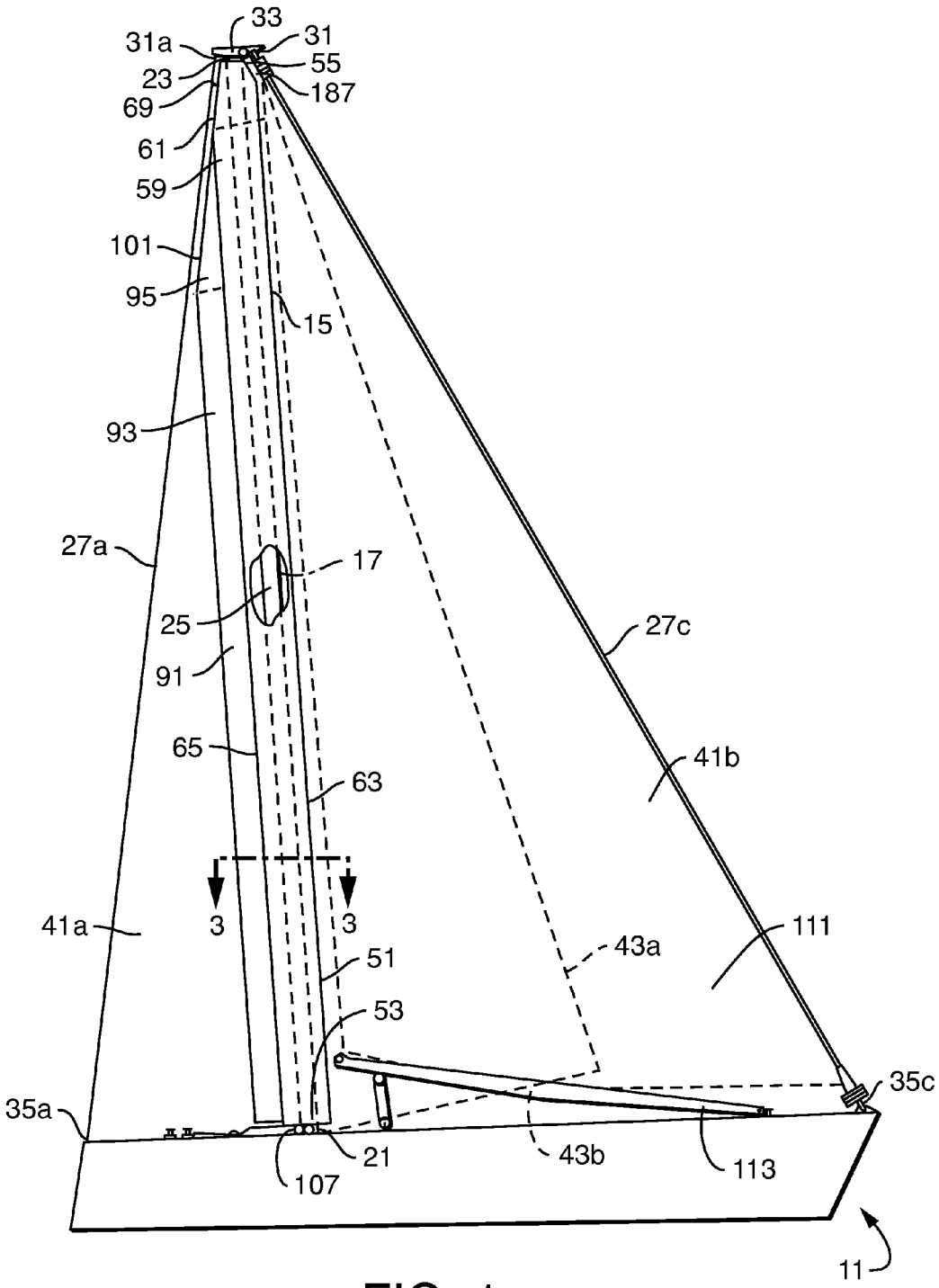
FIG. 1 depicts a device for powering a craft mounted to a watercraft embodying features of the present invention.

Turning now to FIG. 1, a vessel, generally designated by the numeral 11, is depicted having a device 15, embodying features of the present invention for powering a vessel 11 by aerodynamic forces. The device 15 is depicted in partial cutaway, to reveal a mast member 17.

Figure 2:
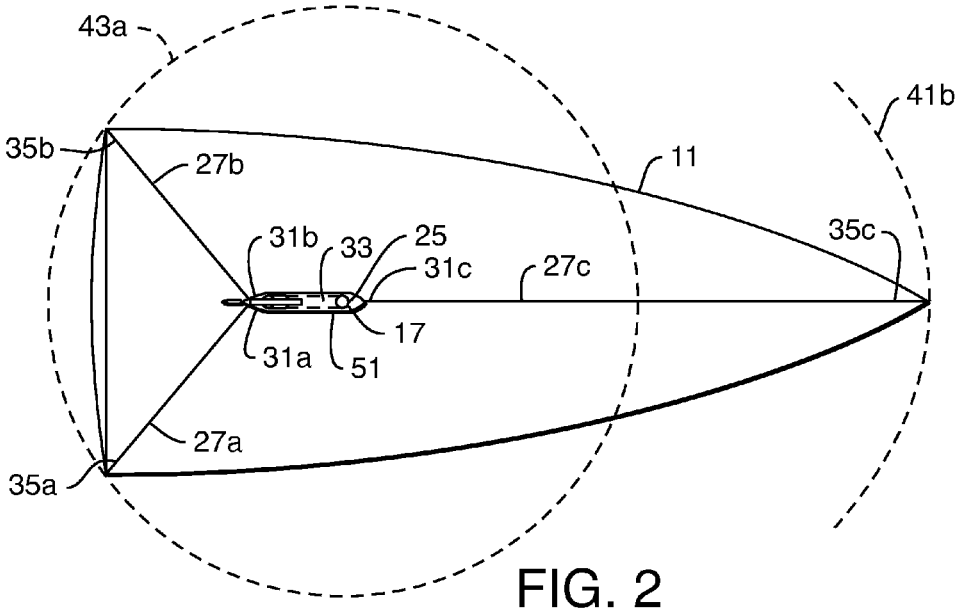
FIG. 2 depicts a top view of a watercraft having a device embodying features of the present invention.
Figure 3:
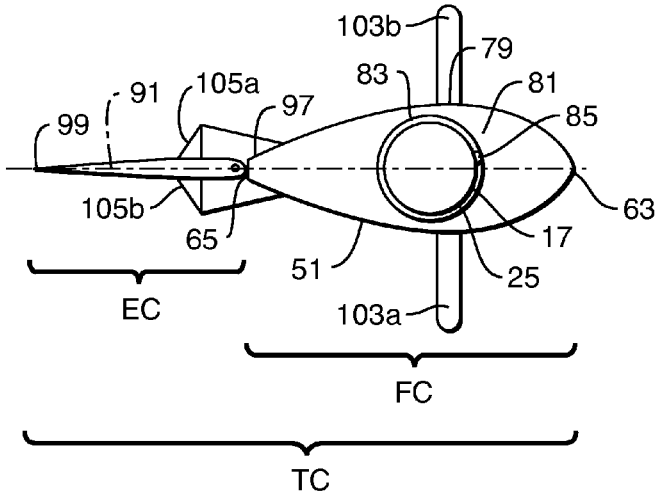
FIG. 3 depicts a sectional view through a device embodying features of the present invention.

The mast member 17 has a base end 21, a top end 23 and an elongated body 25. As depicted in FIGS. 2 and 3, elongated member 25 is cylindrical in shape with a substantially round, circular cross-section, although other cross-sectional shapes may be used. The base end 21 is fixed to a base of a vessel 11. A typical mast member for a twenty-five foot monohull vessel is about twenty five to thirty feet. Multihull vessels typically will have longer mast members for their respective hull length. As best seen in FIGS. 1 and 2, the top end 23 has a masthead 33 with one or more stay attachment points of which three are shown, designated 27*a* and 27*b* for stays directed to the stern of the vessel 11 and 27*c* for a single stay directed to the bow or forward part of the vessel 11.

As seen in FIG. 2, each stay 27*a*, 27*b* and 27*c* has a mast securing end 31*a*, 31*b* and 31*c* fixed to the mast member 17 or, as depicted to a mast head 33 fixed to the top end 23 of mast member 17. And, each stay 27*a*, 27*b* and 27*c* has a craft securing end 35*a*, 35*b* and 35*c* fixed to the craft 11. The stays 27*a*, 27*b* and 27*c* are positioned and constructed to provide the mast with support. Typically, stays 27*a*, 27*b* and 27*c* are stainless steel cables, however, other materials such as carbon fibers, plastics and metals may be used as cables or solid supports may be used. Loads placed on the mast member 17 are transferred to the stays 27*a*, 27*b* and 27*c* and to the craft 11 to provide a robust structure capable of operating in extreme wind conditions.

Each stay 27*a*, 27*b* and 27*c* and the elongated body 25 define at least one cone of rotation 41*a* and 41*b*, if rotated in space. That is, a triangle occupying the space between the elongated member and a stay 27*a*, 27*b*, or 27 will form a cone shape when rotated about the center of the elongated member 25. Stays 27*a* and 27*b* share a common cone of rotation 41*a* because stays 27*a* and 27*b* are fixed to a common point at mast head 33 and an equal distance from the mast base 21. Referring now to FIG. 1, the cone of rotation 41*a* for the two back stays 27*a* and 27*b* is depicted in dotted lines 43*a* and 43*b* and the back stay 27*a*. This cone of rotation is the available space for rotation about the elongated member without interfering with the stay.

Referring to FIG. 2, forward stay 27*c* defines a larger cone of rotation 41*b* which is shown only in part due to the limitation of drawing space. Of the two cones of rotation 41*a* and 41*b*, cone of rotation 41*a* is smaller and is a minimal cone of rotation. As used herein, the minimum cone of rotation means the cone of rotation closest to the mast member 17 for a given point above the mast base 21.

Now returning to FIG. 1, the device 15 comprises a fairing member 51 constructed and arranged for rotational attachment to the mast member 17 and substantially encasing the elongated body 25. The fairing member 51 has a base end 53 and a top end 55 corresponding to the mast member 17. The fairing member 51 has a first section 59 and a second section 61. The first section 59 has a symmetrical aerofoil cross-sectional shape with a projecting rounded forward face 63 and an extending tapered back 65. The first section 59 extends from the base end 53 upwards along the forward face 63 and tapered back 65 to a point inside the minimum cone of rotation 41*a*.

The second section 61 extends from such point inside the minimum cone of rotation 41*a* to the about the top end 55 and has a cross-sectional shape, a second forward face 67 and a second back 69. The second forward face 67 projects no further than and is substantially parallel to the minimum cone of rotation 41*a*. The second back 69 extends no further than and is substantially parallel to said minimum cone of rotation. The cross-sectional shape of second section 61 starting at the first section 59 and moving up, has the appearance of the first section 59 depicted in FIG. 3 and moves toward a more circular shape and the second forward face 67 and second back 69 moves closer to the center of the axis of rotation.

Thus, the fairing member 51 can be rotated a full rotation about the mast 17 to assume one or more positions relative to a wind to provide aerodynamic lift and one or more positions in which the fairing member provides no aerodynamic lift. The fairing can be released to feather in the wind, in the position in which no aerodynamic lift is generated, without interference from the stays.

As can best be seen in FIG. 1, the fairing member 51 has a fairing length defined by the top end 55 and base end 53. And, turning to FIG. 3, the forward face 63 and extending tapered back 65 define a fairing chord distance denoted by bracket FC. The chord distance, returning now to FIG. 1, is approximately constant in the first section 59. The ratio of the fairing length and fairing chord distance is between 5:1 and 60:1. A further embodiment features a ratio of the fairing length and fairing chord distance is between 8:1 and 45:1. Some embodiments of the present fairing feature a fairing length and fairing chord ratio of 9:1 and 35:1.

Returning now to FIG. 3, fairing member 51 has an exterior shell 79 selected from the group of materials consisting of plastic, aluminum, fiber glass, carbon fiber, plastic sheets (such as Mylar) or foil and fabric. Non-rigid materials, such as plastic sheets, foil fabric are preferably to be placed over a structural skeleton [not shown] or a core 81, as illustrated. Core 81 allows rigid exterior shell materials, such as plastic, aluminum, fiberglass and carbon fiber to be used in a manner minimizing thickness. As illustrated the core 81 supports an exterior shell 79 comprising fiber glass. Materials suitable for the core 81 are selected from the group consisting of expanded plastic foam, balsa wood and honeycomb materials.

Fairing member 51 has an axial hollow 83 for rotationally receiving the mast member 17. One or more bearing means are interposed between and affixed to or held in place by at least one of the fairing member 51 and mast member 17. Bearing means comprise such bearing articles such as low friction bushings 85 and rotatable bearing cylinders or balls with races and the like [not shown]. The bearing members reduce friction between the fairing member 51 and the mast member 17.

The fairing member 51 allows the mast member 17, supported and stabilized by one or more stays 27*a*, 27*b* and 27*c*, to withstand extreme wind conditions. The fairing member 51 does not bear significant compression forces associated with the structural mast member 17 and stays 27*a*, 27*b* and 27*c*. The device, fitted to a conventional mast equipped with stays, permits retrofitting of craft formerly fitted with sails.

The fairing member 51 has been depicted and described as a unitary structure. However, the fairing member 51 can be made in segments [not shown] which stack and fit to each other. The segments can be assembled for different mast heights or with different first sections 59 and second sections 61 to accommodate different vessels.

Turning now, again, to FIG. 1, a further embodiment of device 15 comprises a flap 91. The flap has a first flap section 93 and a second flap section 95. As best seen in FIG. 3 the first flap section 93 has a symmetrical aerofoil cross sectional shape, and has a flap front 97 and a flap back 99. The flap back 99 and flap front 97 define a flap chord extending therebetween designated by bracket EC, as best seen in FIG. 3. The flap 91 is moveably affixed at the flap front 97 to the extending tapered back 65 of the fairing member 51 by cooperating hinges, pins and retaining holes and the like [not shown] known in the art. The flap first section 93 extends from the tapered back 65 of the fairing member 51, from the base 53 to a point inside the minimum cone of rotation 41*a* by a distance of the flap chord EC. Returning to FIG. 1, the second flap section 95 extends from the first flap section 93 to the approximately the second section 61 of the fairing member 51. The second flap section 95 has a back edge 101 substantially parallel to and inside minimum cone of rotation 41*a*. The flap 91 is moveable to assume one or more positions relative to the fairing member to increase aerodynamic lift or moveable to assume a position in which the flap provides no aerodynamic lift.

As illustrated in FIGS. 1 and 3 the device features a fairing member having a fairing length and the forward fairing face 63 and flap back 97 which define a fairing flap chord distance denoted by bracket TC. The total fairing flap chord length is approximately constant in the first flap section, the ratio of said fairing length and fairing flap chord distance is between 5:1 and 60:1. And, in a further embodiment the ratio of said fairing length and fairing flap chord distance is between 8:1 and 45:1. Some embodiments of the present fairing feature a fairing length and fairing flap chord ratio of 9:1 and 35:1.

The flap 91 is made in a manner similar to the fairing member with a core and shell or is a solid piece of light weight material such as plastic, fiber glass, light weight metals, or carbon fiber.

The device 15 has fairing control means for compelling said fairing member 51 to assume a position with respect to the wind. The fairing control means comprises one or more arms projecting from the fairing member which are pushed or pulled by lines or hydraulics or fitted with gears or wheels for turning the fairing member 51. FIG. 3 depicts two control arms 103*a* and 103*b* projecting from the sides of the fairing member 51. The control arms are preferably fitted with lines which would be powered by winches. The control arms 103*a* and 103*b* are located about the base 53 of the fairing member 51.

The device 15 has flap control means for compelling the flap to assume a position with respect to the wind. Flap control means comprise one or more flap control arms projecting from at least one of the fairing member 51 or flap 91 which are pushed or pulled by lines or hydraulics or fitted with gears of wheels for turning the flap 91 with respect to the fairing member 51. As best seen in FIG. 3, as illustrated, flap control means in the form of flap control arms 105*a* and 105*b* project from each side of the flap 91 and are controlled by flap control lines which travel through line channels [not shown] running down the fairing member to the base 53.

The fairing member 51 rests on base bearings 107 allowing the fairing member 51 to rotate about the mast member 17. The fairing member 51 does not need to carry the weight and structural load of the mast member 17 and stays 27*a*, 27*b* and 27*c* and can assume positions influenced by the wind when control means are not determining the position. That is, the fairing member 51 can be readily feathered, in a non-powering position.

The device 15 may have an integrated mast member 17 or can readily be fitted to existing masts. Similarly, the device 15 may be integrated into a craft such as craft 11. As illustrated craft 11 features at least one head stay 27*c* that carries a sail 111. The sail 111 is fitted to a boom 113. The boom 113 extends from about the head stay 27*c* to a point towards the mast member 17 allowing said fairing member 51, and if the device comprises a fairing member 51 and flap 91, allowing the fairing member 51 and flap 91, to freely rotate.

The method of the present invention for powering a craft 11 will now be described with respect to the operation of the device 15 with respect to FIGS. 1 and 4*a*, 4*b*, 4*c* and 4*d*. The craft 11 has a mast member 17 having a base end 21, a top end 23 and an elongated body 25. The base end 21 is attached to the craft 11 and the top end 23 has a mast head 33 with stay attachment points. Each stay 27*a*, 27*b* and 27*c* is secured to the mast member 17 and the craft 11 defining at least one cone of rotation and at least one of said cone of rotation being a minimal cone of rotation. The method comprises the step of providing a device 15 having a fairing member 51 constructed and arranged for rotational attachment to the mast member 17 and substantially encasing the elongated body 25. The fairing member 51 has a base end 53 and a top end 55 corresponding to the mast member 17 and has a first fairing section 59 and a second fairing section 61. The first fairing section 59 extends from the base towards a point inside the minimum cone of rotation 41*a*. The first fairing section 59 has a symmetrical aerofoil cross-sectional shape with a projecting rounded forward face 63 and an extending tapered back 65. The second fairing section 61 extends from the first fairing section 59 to the about the top end 55 and has a cross-sectional shape a second forward face 67 and a second back 69. The second forward face 67 projects no further than and substantially parallel to the minimum cone of rotation 41*a*, and the second back 69 extends no further than and substantially parallel to said minimum cone of rotation 41*a*.

Figure 4A:
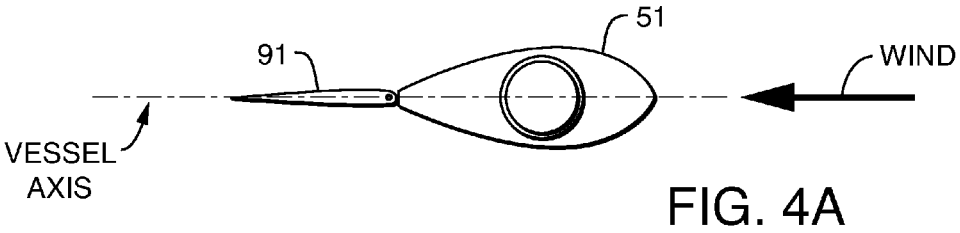
FIG. 4A depicts a device in a non-powering position.

Thus, the fairing member 51 can be rotated a full rotation about the mast to assume one or more positions relative to a wind to provide aerodynamic lift and one or more positions in which the fairing member provides no aerodynamic lift. Turning now to FIG. 4*a*, the step of rotating the fairing member 51 to assume a position in which no aerodynamic lift is provided is illustrated, for example when the vessel is steered directly into the wind or the vessel is at anchor and the fairing member is allowed to feather.

Figure 4B:
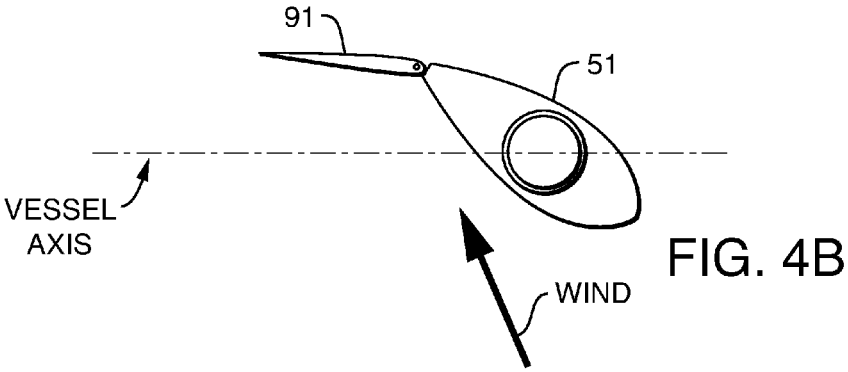
FIG. 4B depicts a device in powering position.
Figure 4C:
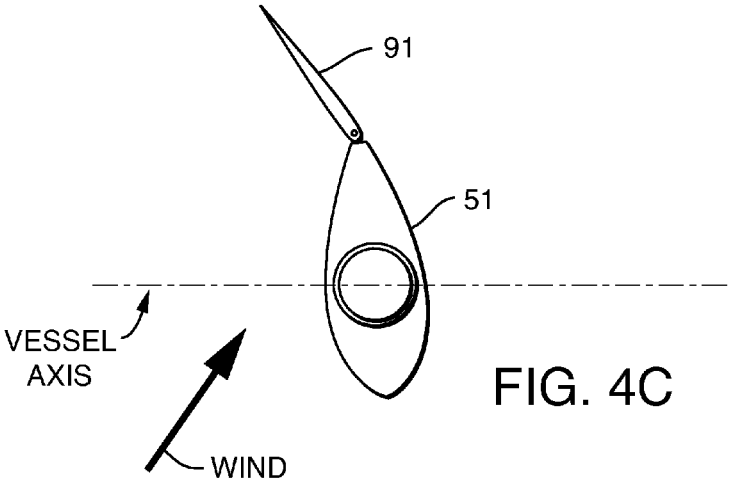
FIG. 4C depicts a device in a powering position.

FIG. 4*b* depicts fairing member 51 rotated to provide aerodynamic lift with wind approaching the craft from a 2 o'clock position. FIG. 4*c* depicts the fairing member 51 rotated to provide aerodynamic lift with the wind approaching from a 4 o'clock position.

Figure 4D:
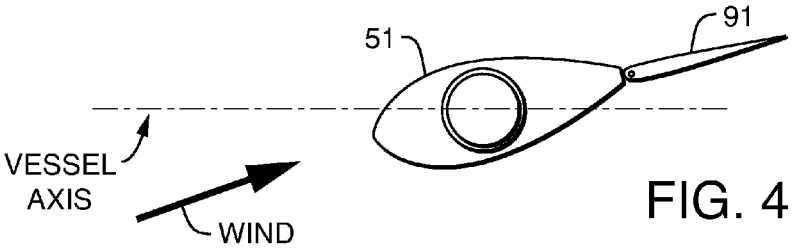
FIG. 4D depicts a device in a non-powering position.

FIG. 4*d* depicts the fairing member 51 allowed to feather or freely rotate about the mast member 17 as wind approaches the craft from the 5 o'clock position, assuming a position in which no aerodynamic lift is generated. This position is important where the craft may be experiencing extreme winds in a storm.

FIGS. 4*a*, 4*b*, 4*c* and 4*d* depict the fairing member 51 and flap 91. Fairing member 51 and flap 91 are used in conjunction to increase the efficiency of device 15. The flap is set relative to the wind and fairing member 51 to increase aerodynamic lift or if no lift is desired allowed to feather of left in line with the fairing member 51. For example, referring to FIG. 4*a*, no lift is desired while a craft 11 is stationary as a watercraft at anchor. The flap 91 is set inline with or allowed to assume a position in line with fairing member 51.

FIG. 4*b* depicts fairing member 51 rotated to provide aerodynamic lift with wind approaching the craft from a 2 o'clock position and flap 91 set to provide additional aerodynamic lift by being pulled in with respect to the direction of the wind. FIG. 4*c* depicts the fairing member 51 rotated to provide aerodynamic lift with the wind approaching from a 4 o'clock position and flap 91 set to provide additional aerodynamic lift by being pulled in with respect to the direction of the wind.

FIG. 4*d* depicts the fairing member 51 allowed to feather or freely rotate about the mast member 17 as wind approaches the craft from the 5 o'clock position assuming a position in which no aerodynamic lift is generated and flap 91 is held in an inline position or freely rotate to assume such inline position also providing no aerodynamic lift. Again, this position is important where the craft may be experiencing extreme winds in a storm.

Thus, we have described the device and methods of making and using the device. The device has rigid aerodynamic lift surfaces that can be controlled through all wind directions, and is structurally robust for carrying one or more sails. Embodiments of the present invention described and illustrated herein are the best mode presently contemplated for making and using the invention and as such are capable of modification and alteration. Therefore, the present invention should not be limited to the precise details set forth herein but should encompass such subject matter of the claims that follow and their equivalents.

The invention claimed is:

1. A device for powering a craft by aerodynamic forces, said craft having a mast member having a base end, a top end and an elongated body, said base end constructed and arranged for attachment to a base of said craft and said top end having one or more stay attachment points for at least one stay, said at least one stay having a mast securing end and a craft securing end, said at least one stay and said elongated body defining at least one cone of rotation when secured to said craft and mast member, and at least one of said cone of rotation being a minimal cone of rotation; said device comprising:

a fairing member constructed and arranged for rotational attachment to said mast member and substantially encasing the elongated body, said fairing member having a base end and a top end corresponding to said mast member and having a first fairing section and a second fairing section, said first fairing section extending from the base towards a point inside the minimum cone of rotation, said first fairing section having a symmetrical aerofoil cross-sectional shape with a projecting rounded forward face and a extending tapered back, said second fairing section extending from said first fairing section to the about the top end and having a cross-sectional shape a second forward face and a second back, said second forward face projecting no further than and substantially parallel to the minimum cone of rotation, and said second back extending no further than and substantially parallel to said minimum cone of rotation;

such that said fairing member can be rotated a full rotation about said mast to assume one or more positions relative to a wind to provide aerodynamic lift and one or more positions in which the fairing member provides no aerodynamic lift.

2. The device of claim 1 wherein said fairing member has a fairing length and said forward face and extending tapered back define a fairing chord distance which is approximately constant in said first section, the ratio of said fairing length and fairing chord distance is between 5:1 and 60:1.

3. The device of claim 1 wherein said fairing member has a fairing length and said forward face and extending tapered back define a fairing chord distance which is approximately constant in said first section, the ratio of said fairing length and fairing chord distance is between 8:1 and 45:1.

4. The device of claim 1 further comprising a flap, said flap having a first flap section and a second flap section, said first flap section having a symmetrical aerofoil shape having a flap front and a flap back, and having a flap chord extending therebetween said flap moveably affixed along said extending tapered back and extending from the tapered back of said fairing member from said base to a point inside said minimum cone of rotation by a distance of said chord and said second flap section extending from said first flap section to said second section of said fairing and having a flap back edge substantially parallel to and inside said minimum cone, said flap moveable to assume one or more positions relative to said fairing member to increase aerodynamic lift or moveable to assume a position in which the flap provides no aerodynamic lift.

5. The device of claim 4 wherein said fairing member has a fairing length and said forward face and flap back define a fairing flap chord distance which is approximately constant in said first flap section, the ratio of said fairing length and fairing flap chord distance is between 5:1 and 60:1.

6. The device of claim 4 wherein said fairing member has a fairing length and said forward face and flap back define a fairing flap chord distance which is approximately constant in said first section, the ratio of said fairing length and fairing flap chord distance is between 8:1 and 45:1.

7. The device of claim 1 wherein said fairing member has an exterior shell selected from the group of materials consisting of plastic, aluminum, fiber glass, and carbon fiber.

8. The device of claim 7 wherein said fairing member has a core.

9. The device of claim 8 wherein said core is comprised of a material selected from the group consisting of expanded plastic foam, balsa wood and plastic honeycomb.

10. The device of claim 8 wherein said core has an axial hollow for rotationally receiving said mast member.

11. The device of claim 10 further comprising one or more bearing means for reducing friction between said fairing member and said mast member.

12. The device of claim 1 further comprising fairing control means for compelling said fairing member to assume a position with respect to the wind.

13. The device of claim 4 wherein at least one of said fairing member and flap has flap control means for compelling said flap to assume a position with respect to the wind.

14. The device of claim 1 further comprising a mast member.

15. The device of claim 14 further comprising a craft.

16. The device of claim 15 wherein said mast member is secured to said craft by at least one stay and said at least one stay comprises at least one head stay.

17. The device of claim 16 wherein said at least one head stay carries a sail.

18. The device of claim 17 wherein said sail is fitted to a boom and said boom extends from about the head stay at the craft to a point towards said mast allowing said fairing member to freely rotate.

19. The device of claim 18 further comprising a flap, said flap having a first section and a second section, said first section having a symmetrical aerofoil shape having a flap front and a flap back, and having a flap chord extending therebetween said flap moveably affixed along said extending tapered back and extending from the tapered back of said fairing member from said base to a point inside said minimum cone of rotation by a distance of said chord and said second section extending from said first section to said second section of said fairing member and having a flap back edge substantially parallel to and inside said minimum cone of rotation, said flap moveable to assume one or more positions relative to said fairing member to increase aerodynamic lift or moveable to assume a position in which no aerodynamic lift is increased, said boom extending from about the head stay at the craft body to a point towards said mast allowing said fairing member and said flap to freely rotate about said mast.

20. A method for powering a craft by aerodynamic forces, said craft having a mast member having a base end, a top end and an elongated body, said base end constructed and arranged for attachment to a base of a craft and said top end having one or more stay attachment points for at least one stay, said at least one stay having a mast securing end and a craft securing end, said at least one stay and said elongated body defining at least one cone of rotation when secured to said craft and mast member, and at least one of said cone of rotation being a minimal cone of rotation; said method comprising the step of:

providing a device having a fairing member constructed and arranged for rotational attachment to said mast and encasing substantially the elongated body, said fairing member having a base end and a top end corresponding to said mast member and having a first section and a second section, said first section extending from the base towards a point inside the minimum cone of rotation, said first section having a symmetrical aerofoil cross-sectional shape with a projecting rounded forward face and a extending tapered back, said second section extending from said first section to the about the top end and having a cross-sectional shape a second forward face and a second back, said second forward face projecting no further than and substantially parallel to the minimum cone of rotation, and said second back extending no further than and substantially parallel to said minimum cone of rotation;

such that said fairing member can be rotated a full rotation about said mast to assume one or more positions relative to a wind to provide aerodynamic lift and one or more positions in which the fairing member provides no aerodynamic lift;

and rotating said fairing member to assume said one or more positions relative to the wind to provide aerodynamic lift to power said craft and rotating or allowing said fairing member passively assume said one or more positions in which the fairing member provides no aerodynamic lift when it is desired to maintain the craft in an unpowered state.

21. The method of claim 20 wherein said device further comprises a flap, said flap having a first section and a second section, said first section having a symmetrical aerofoil shape having a flap front and a flap back, and having a flap chord extending therebetween said flap moveably affixed along said extending tapered back and extending from the tapered back of said fairing member from said base to a point inside said minimum cone of rotation by a distance of said chord and said second section extending from said first section to said second section of said fairing member and having a flap back edge substantially parallel to and inside said minimum cone of rotation, said flap moveable to assume one or more positions relative to said fairing member to increase aerodynamic lift or moveable to assume a position in which the flap provides no aerodynamic lift.

* * * * *